United States Patent [19]

Wang

[11] Patent Number: 4,545,590

[45] Date of Patent: Oct. 8, 1985

[54] COMPOSITE WOODEN HORSE CART WITH FORWARD AND BACKWARD CONTROLS

[76] Inventor: Chin-Chung Wang, 29, Alley 2, Lane 47, Shiang Shih Rd., Sec. 2, Pan Chiao Taipei Hsien, 220, Taiwan

[21] Appl. No.: 465,662

[22] Filed: Feb. 10, 1983

[51] Int. Cl.[4] ..... A63G 15/00

[52] U.S. Cl. ..... 280/1.175

[58] Field of Search ..... 280/1.175, 1.177, 1.182, 280/1.193; 180/7.1; 272/52

[56] References Cited

U.S. PATENT DOCUMENTS

| | | | |
|---|---|---|---|
| 1,807,428 | 5/1931 | Muehlfeld et al. | 280/1.193 X |
| 1,809,739 | 6/1931 | Taylor | 280/1.193 |
| 1,907,848 | 5/1933 | Martin | 280/1.175 |

FOREIGN PATENT DOCUMENTS

| | | | |
|---|---|---|---|
| 519486 | 5/1953 | Belgium | 280/1.193 |

*Primary Examiner*—John A. Pekar

*Attorney, Agent, or Firm*—Armstrong, Nikaido, Marmelstein & Kubovcik

[57] ABSTRACT

A toy rocking horse cart with forward and backward controls for children's entertainment consisting of an arc shaped base mounting, chassis, horse body, seat, back resting board, handle, reinforcement battens on the arc shaped base mounting, and other constituent parts, characterized by the fact that conversion of impulses and impetuses produced by the horse rocking on the cart into one-way momentums by the actions of the ratchet wheel sets and check claws therefor so that the cradle will be driven to move forward or else backward, with means to control and to change the direction in which the cart moves. The cart is also provided with braking means to protect the safety of a child rider in getting on or getting off the horse.

6 Claims, 5 Drawing Figures

COMPOSITE WOODEN HORSE CART WITH FORWARD AND BACKWARD CONTROLS

SUMMARY OF THE INVENTION

A composite rocking horse cart with mechanism for forward and backward movement control, characterized by its ability to convert reactive impulses as produced by the rocking of the horse on a wheeled cradle or cart into a momentum to move the cart forward or backwards. This ability is due to inner action between the mechanism on the front shaft or axle of the cart which controls the cart to effect an automatic reversal of travel upon reaching a designated distance, complete with a braking system to protect the safety of the rider, especially children, so that the cart may be brought to a complete halt in case of an impending emergency. Preferably the constituent parts of the device are made of wood and are screw fastened together so that they may be undone into components for simplifying storing or transporting the device.

BACKGROUND OF THE INVENTION

A rocking horse cart is a very popular toy for children everywhere, and almost everybody has had the experience of a ride on a rocking horse cart sometime in his childhood. It is well known that children love to ride on a rocking horse which may be accounted for by reason of the fact that it is satisfying and pleasurable to be astride of the horse's back like a conqueror rocking and swaggering back and forth.

However for many years there has been little breakthrough or improvement in the structure and operation of a conventional rocking horse. Typically a rocking horse is made of wood and has its constituent parts assembled with nails. While assembled it is useful for giving children rides, but occupies a bulky space while not in use with little ease for handling and transporting. It is also bulky and requires quite a bit of space. The modes of playing with a conventional stationary wooden horse cart have remained unchanged for many years and the rider's interest will become diverted to other sorts of entertainments, because of the monotony or lack of novelty of what a stationary rocking horse cart can offer in terms of riding pleasure. With rising living standards many children will not long be satisfied with out of date and old fashioned playing tools or toys. For this reason the present invention was developed with years of study and experimentation to provide a more intriguing toy for children everywhere.

DETAILED DESCRIPTION

A primary object of the present invention is to provide a means whereby the rocking horse cart may move forward or backward by means of the reacted impulses from the action of vibration or rocking, such that the enjoyment of a horse cart will be enhanced to a dynamic mode instead of the static mode of operation. Because the horse cart of the present invention provides forward and reverse movement of the cart in addition to the rocking pleasures, the rider may feel like he is actually riding a moving horse.

Still another object of the present invention is to achieve an automatic reversal of the cart upon reaching a prescribed distance by virtue of the mechanism which can be adjusted to conform to the space that is available, thus avoiding hitting a surrounding wall and allowing the child rider to play in safety.

Still another object of the present invention is to provide for a braking device such that the child rider himself may have the cart under control while getting on or getting off of the horse cart, and to enable the horse cart to be stopped all at once in the presence of an impending emergency during the ride.

Another object of the present invention is to achieve an assembly and disassembly of the parts by screw locking techniques to facilitate handling and transportation with minimum space requirements, and so that the child rider standing by may observe the fitting and dismounting procedures and have an early chance to learn about mechanics.

To give a better understanding of the present invention there follows a detailed description with reference to the accompanying drawings.

Figure 1:
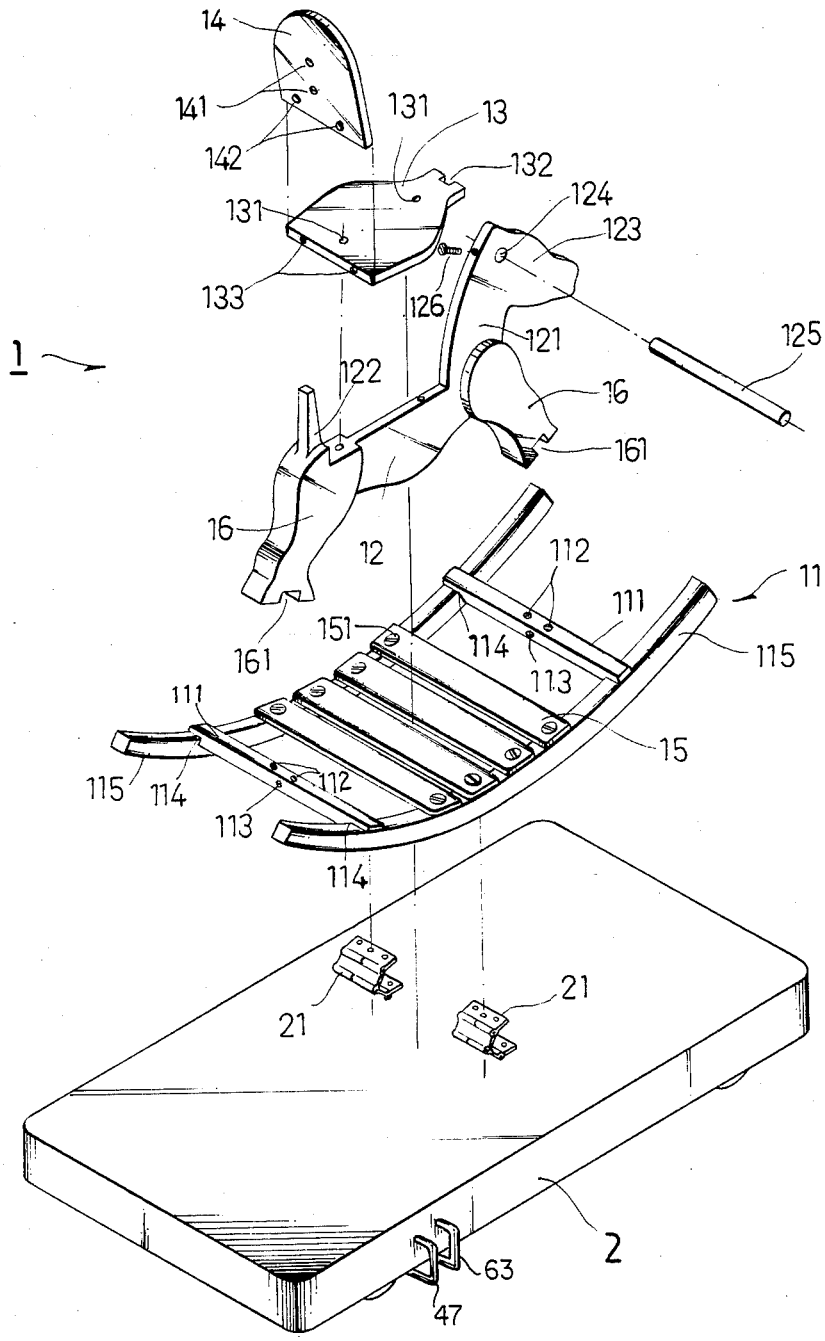
FIG. 1 is an exploded perspective view of a rocking horse toy embodying the present invention.

FIG. 1 shows a three-dimensional exploded perspective of the present invention showing a wooden rocking horse indicated generally by the numeral 1 comprising an arcuate base 11 a horse body 12, a seat support member 13, a back-rest board 14, and a plurality of pedals 15 disposed beneath the hind and front legs 16 of the horse. Each lower end of the front and back legs 16 is provided with a crosswise flute 161 to interfit with two cross-set batten members 111. The legs 16 of the horse are secured with screws to the battens 111 through screw holes 112 and 113 to secure the horse body 12 to the arcuate base member 11. The cross battens 111 are notched as indicated at 114 to fit onto two arcuate rocking bows 115 at each of the ends thereof. This serves to reinforce the stability of the rocking bows 115 so that they may remain in vertical position, and are sturdily held. The ends, of each of the pedal members 15 is screwed by screws 151 to the middle portions of the arc bows 115 to further reinforce the stability of the arc bows 115. The seat member 13 is fixed to the horse body 12 with screws through the screw holes 131. The front of the seat with respect to the horse's neck 121. The back rest 14 rests against the horse's body 12 in a gap between the seat member and the tail 122 of the horse. The back rest may be locked to the horse's tail 122 by screws passing through screw holes 141 in the back rest and may also be secured to the seat member by screws passing through the holes 142 in the back rest which are aligned with holes 133 of the seat member. A hole 124 is provided in the horse's head 123 through which a handle 125 may pass and be secured by a screw 126. The horse 1 is linked to the cradle or cart 2 by means of two hinges 21 which serve to guide and control the direction and location at which the horse will rock; at the same time not permitting the horse to be tilted to an irrecoverable condition.

Figure 2:
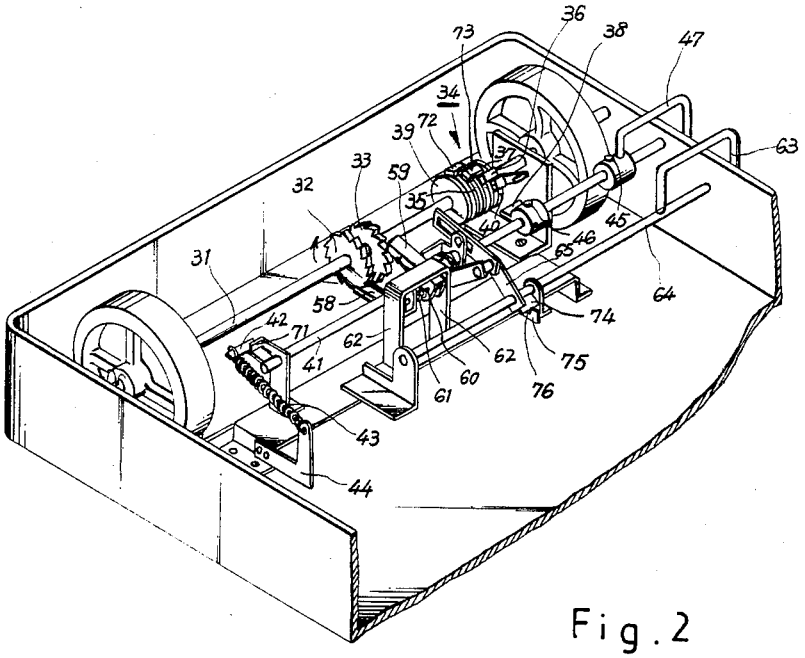
FIG. 2 is a fragmentary perspective view of the inverted cart of the toy embodying the present invention.

The inverted fragmentary perspective of the chassis of the cart in FIG. 2 shows the front axle 31 mounted for rotation in the body of the cart 2. A forward ratchet wheel 32 and a reverse ratchet wheel 33 complimentary to each other but opposite in direction are fixed to the front wheel axle 31. Axially spaced along the axle 31 is a guide ring set 34 mounted for rotation on the axle with each of the plurality of guide rings spaced apart by washers 35. Connected to and extending from each guide ring 34 is a projecting L-shaped rod 36 whose axial length is enough to contact and push an adjacent L-spaced rod of an adjacent guide ring. The terminal guide ring 37 is dimensioned and positioned to contact the automatic guide lever 38 which is mounted on shaft 41 and may be locked thereto by such screw 46.

A discharge shaft 41 is journaled in the frame of the cart and is disposed parallel to the shaft 31. The guide ring set 34 is located between the two fixed ringlets 39 and 40 on the shaft 31. The terminal guide ring 37 is designed to take into account the automatic guide rod 38 so that it will interact therewith. On the ringlet 39 approaching the terminal end of the first guide there is also provided an L-shaped rod 72 to engage and move the rod 73 on the first guide ring. The end of the shaft 41 carries a crank arm 42. Adjacent the crank is a fixed arm 44 secured to and extending upwardly from the shell of the cart 2 and the end of the arm 44 is attached to the crank 42 by a tensile spring 43. At the other end of the shaft 41 a control lever 47 is secured to a boss on the shaft and may be locked thereto by a set spring 45.

Figure 3:
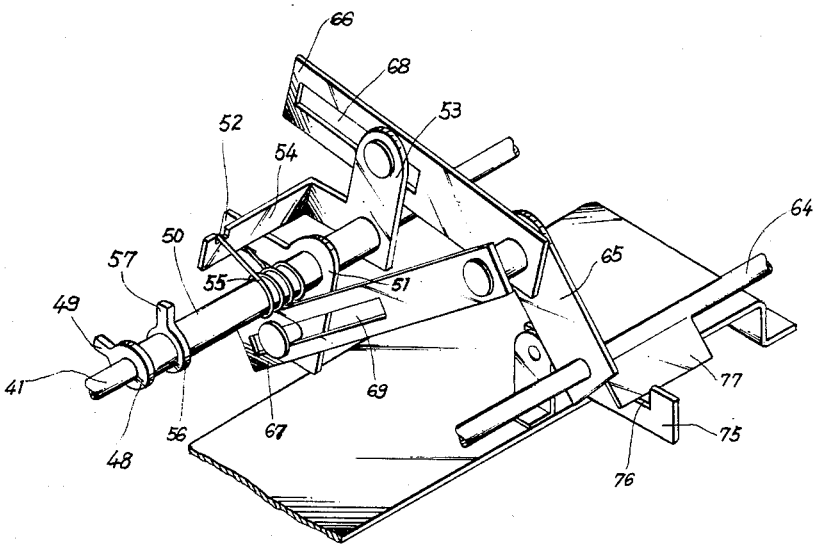
FIG. 3 is a partial perspective of the braking device enlarged from its showing in FIG. 2.

In FIG. 3 it may be seen that an annular cam 48 is fixed to the shaft 41 opposite the left hand ratchet wheel 32 and carries an outwardly projecting lug 49. Adjacent the annualar cam 48 is a sleeve 50 mounted on the shaft 41. Welded to stand perpendicular to the shaft at a point near the end of the sleeve 50, a bent arm 53 is mounted on the shaft 41. The bent arm 53 and a free arm 51 mounted on the sleeve 50, are notched so that the ends of a closure coil spring 55 wrapped around the sleeve 50 may be connected so that the free arm 51 will be urged to remain adjacent to the arm 53 by the spring action. At a point on the sleeve 50 opposite the reverse ratchet wheel 33 there is provided an annular cam 56 with a lug 57. Pawls or check claws 58 and 59 respectively are attached at one end to cross bars 60 mounted on shaft 41 the other ends of which pass beyond the upper side and under side of the discharge shaft 41. A closure spring 61 is provided on the cross bar 60 so that each of the pawls or check claws 58 and 59 may be attached thereto so that they can engage and interact with the ratchet wheels 32 and 33 and that the check claws can be held together resiliently to maintain their respective positions. A U-shaped board or strap 62 mounted to the chassis of the cart 2 encloses the ends of the cross bars 60.

A braking rod 63 is mounted on and controls the rotation of braking shaft 64. This shaft has a rocker arm 65 opposite and in between the ratchet wheels 32, 33. The terminal end of the rocker arm 65 is attached to two lever arms called bumper levers 66 and 67 which also have windows or slots 68 and 69 to accommodate a gliding coupling with the free arm 53 and the bent arm 51 the rocker arm 65 being pivoted to the two bumper levers 66, 67.

Manual control of the present invention is as follows. First turn tight screw 45 to achieve a tight coupling between the control lever 47 and the discharge shaft 41, then loosen screw 46 so that the automatic lever 38 is free on the discharge shaft 41 (to facilitate description, the position of the screws is shown at the bottom but they should be located in the top in practical operations). With the control lever 47 in the position shown in the drawings then the discharge shaft 41 can be rotated which rotates lug 49 as well because the sleeve 50 will follow in rotation with the discharge shaft 41 so that lug 49 will react to release the thrusting effects borne against the check claws 58, 59 to result in setting the check claw 58 to thrust upwards and catch hold of the forward ratchet wheel 32 by the elasticity of the closure spring 61 whereas the other check claw 59 will part from the reverse ratchet wheel 33 under the thrusting stress borne by lug 57. That is, the checking function of the check claw 58 being applicable against the returning trend it is possible to bring the right ratchet wheel 32 to rotate solely in the direction given in the drawings and the cart wheel including the wooden horse cart will move either forward or backward but never altogether at the same time. When the control lever 47 is shifted to the opposite position then the check claw 59 will be in a position to exert thrusting stress against the right ratchet wheel and the wooden horse cart will turn to move in reverse direction. A stabilized condition is achieved after running of the discharge shaft 41 by virtue of the contracting resilience of the stretching spring 43 that is, because after the completion of one rotation of the shaft the crank 42 will be bound to pass by the upper dead point of the longitudinal journey as the stretching spring 43 is stretched out full and the stop 71 serves to control and stop the angular displacement of the discharge shaft in each rotation.

Now follows a description of operation in the automation mode. Tighten the set screw 46 so that the automatic lever 38 is locked onto the discharge shaft 41 that drives the axle 31 to rotate in one direction. As the cart moves, the L-shaped rod 72 on the ring 39 will react to push on an L-shaped rod 73 provided on the first guide ring so that the first guide ring will rotate in step with the axle 31. Following that the L-shaped rod 73 on the first guide ring will give traction to the L-shaped rod on the second guide ring and the second guide ring will turn to give traction to the third guide ring in sequence like a chained traction transmission until the L-shaped rod on the last guide ring accomplish transmission of the automatic guide rod 38 to bring about an angular displacement of the discharge shaft 41 in a longitudinal direction which will cause a change in the direction in which the horse cart moves. Now as the wheel axle 31 makes one turn in the opposite axial direction, the L-shaped rod 73 on top of the guide rings will react to give movement to the first guide ring in the reverse direction. The first guide ring after accomplishing one turn of rotation in a direction counter to the movement of the axle due to L-shaped rod 72 will start to give transmission to the second guide ring, and eventually resulting in pushing the automatic guide rod 38 back to its original position under the transmission of the last guide ring 37. The result is that the wooden horse cart will again move in the direction prevailing in the first instance. Thus by determining the peripheral circumference of the wheel axle and selecting the correct number of guide rings 34 the distance of the journey traveled by the horse cart in the course of one change of the cycle in the automatic operation can be controlled.

Figure 4:
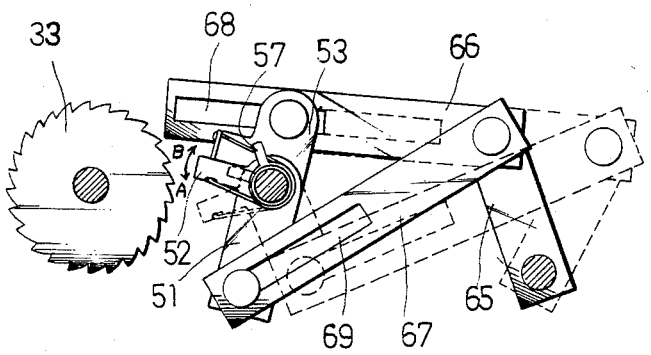
FIG. 4 is an enlarged elevational fragmentary sectional view of a portion of the mechanism.

One essential principle in the present invention is to achieve having the check claws 58, 59 exercising thrust against the ratchet wheels all at once so that the wheel axle will not rotate but hold stand still. Referring to FIG. 2 it is seen there are two syles of braking operations, one for cases where the command of the braking lever 63 is desired when ratchet wheel 32 alone is thrust caught by check claw 58 a detailed illustration of the procedure is given in FIG. 4. It may be seen that the braking shaft 64 will rotate with the braking lever 63 thus rotating the rocker arm 65, pulling the bumper levers 66, 67. The position relationship between the free arm 51 and the bent arm 53 and the bumper levers at this juncture will be such that the bent arm 53 can enjoy a free gliding movement in the window slot 68 in the bumper lever 66, and the free arm 51 will be pulled up instantly by the bumper lever 67 to rotate the sleeve 50 so that the lug 57 as attached to the sleeve 50 will rotate in the direction A, and the check claw 59, activated as it is by lug 57, will exert a thrusting catch of the ratchet wheel 33 by spring force of the spring 61. Since when the braking action commenced, check claw 58 and ratchet wheel 32 were in locking engagement, now both check claws 58, 59 are in locking engagement with ratchet wheels 32, 33, the wheel axle 31 will not be free to rotate in either direction and a braking action has been attained at this time. However, the closure spring 55 which was driven open by the rotation of sleeve 50, will attempt to force the sleeve to return back to its original position, but the spring 55 will not be allowed to exert this force. The shaft 41 did not follow the sleeve 50 in rotating owing to the larger pull produced by the stretching spring 43 than that of the spring 55. If the braking action were to persist, spring 55 would return sleeve 50 to its original position and lug 57 will move in direction B and thrust claw 59 will free itself from the right ratchet wheel 33. Alternatively, the braking lever 63 may be returned to its original position, and the horse cart may progress in one-way direction again.

Figure 5:
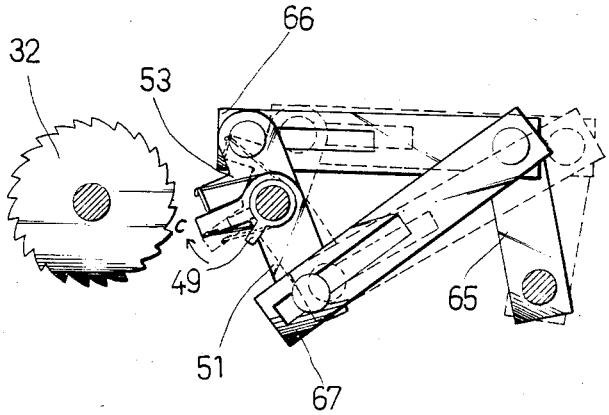
FIG. 5 is an enlarged elevational fragmentary sectional view of a portion of the mechanism in a slightly different part of the operating cycle.

The second form of braking operation is in case where the ratchet wheel 33 alone is in operating engagement with check claw 59 to progress in the opposite direction and a braking action is desired, reference should be made to FIG. 5. When the braking lever is turned, the relationship covering the free arm 51 and the bent arm 53 and the bumper levers 66 and 67 at the moment is shown. Due to the angular displacement of the discharge shaft 41, the turning of the braking shaft 64 by the rod 63 will turn the crank 65 pulling on the bumper lever 66, will pull the arm 53 to set the discharge shaft 41 in rotation and lug 49 will follow in direction C. Bumper lever 67 will not move arm 51 due to slot 69, but lug 49 will cause check claw 58 to be in locking engagement with ratchet wheel 32, thus effecting the complete braking action. To prevent the spring 61 from allowing check claw 59 from disengagement with ratchet wheel 33, or from over stretching spring 43, the proper angular turn of braking shaft 64 can cause a bumper fin 77 affixed to shaft 64 to turn into notch 73 provided in an elastic cross bar 75 adjacent the braking shaft 64.

I claim:

1. A rocking horse cart toy which comprises:

(a) a simulated horse with means for a child to sit astride the horse, (b) a wheeled cart with means for mounting the horse thereon and to provide a controlled rocking movement, (c) a forward pawl and ratchet mechanism and a reverse pawl and ratchet mechanism mounted on an axle of said cart, each mechanism effective in its direction for a selected distance to effect conversion of impulses of the rocking movement of the horse into a one way movement of the cart wheels, and (d) a reversal means for transferring axle control from one pawl and ratchet mechanism to the other at the conclusion of the selected distance.

2. A rocking horse cart toy as claimed in claim 1 and additionally comprising a braking means to prevent effective movement of said cart.

3. A rocking horse cart toy as claimed in claim 1 wherein said braking means includes means for manually applying said braking means.

4. A rocking horse cart toy as claimed in claim 1 wherein said simulated rocking horse, and said cart include means for detachably securing the same together so that they may be readily disassembled for storage and transporting purposes.

5. A rocking horse cart toy as claimed in claim 1 wherein said simulated horse comprises at least one wooden arc shaped base, a wooden body, a wooden seat, a wooden back rest, a wooden handle, and a pair of wooden pedals, all assembled together by threaded assembly means.

6. A rocking horse cart toy as claimed in claim 1 wherein said pawl and ratchet mechanisms are effective for the selected distance as measured by a plurality of guide rings set on the axle with the individual guide rings being advanced consecutively.

* * * * *